United States Patent [19]

Winters

[11] 4,279,612

[45] Jul. 21, 1981

[54] PRODUCTION OF STABILIZED ACRYLIC FIBERS

[75] Inventor: Richard D. Winters, Elizabethton, Tenn.

[73] Assignee: Great Lakes Carbon Corporation, New York, N.Y.

[21] Appl. No.: 143,083

[22] Filed: Apr. 23, 1980

[51] Int. Cl.[3] ..... D06C 7/04; D01F 9/22

[52] U.S. Cl. ..... 8/115.5; 423/447.4; 423/447.6

[58] Field of Search ..... 423/447.4, 447.6; 8/115.5; 264/29.2

[56] References Cited

U.S. PATENT DOCUMENTS

| | | | |
|---|---|---|---|
| 3,027,222 | 3/1962 | Wilkinson | 8/115.5 |
| 3,539,295 | 11/1970 | Ram | 423/447.6 |
| 3,814,577 | 6/1974 | Menikheim | 423/447.6 |
| 3,862,334 | 1/1975 | Turner | 423/447.6 |
| 3,954,947 | 5/1976 | Didchenko et al. | 423/447.6 |
| 3,961,888 | 6/1976 | Riggs | 8/115.5 |
| 4,009,991 | 3/1977 | Matsumura et al. | 432/23 |

*Primary Examiner*—Edward J. Meros
*Attorney, Agent, or Firm*—R. Laddie Taylor

[57] ABSTRACT

An acrylic fiber bundle is rapidly thermally stabilized in an oxidative atmosphere by exposure to a selected temperature profile as the fiber passes through varying density ranges during stabilization.

3 Claims, 1 Drawing Figure

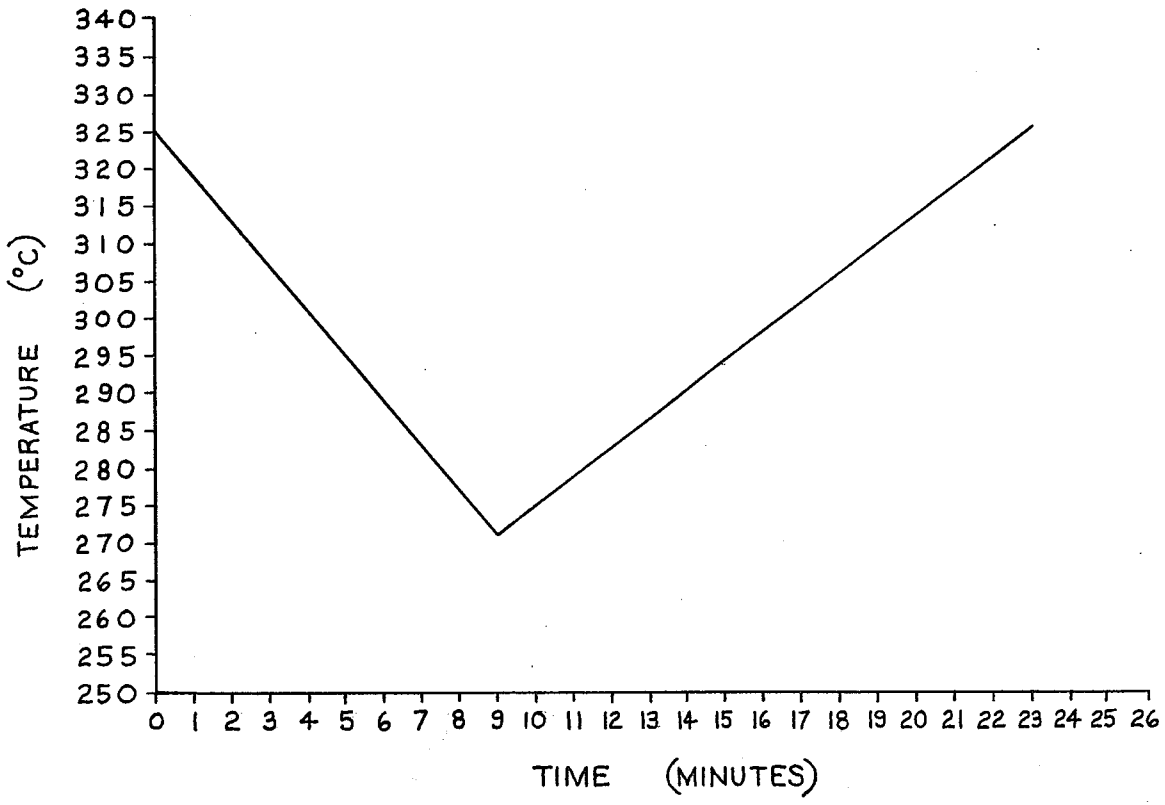
TEMPERATURE (°C)
340
335
330
325
320
315
310
305
300
295
290
285
280
275
270
265
260
255
250
0 1 2 3 4 5 6 7 8 9 10 11 12 13 14 15 16 17 18 19 20 21 22 23 24 25 26
TIME (MINUTES)

PRODUCTION OF STABILIZED ACRYLIC FIBERS

BACKGROUND OF THE INVENTION

The invention relates to means for rapidly stabilizing acrylic fibers by precisely controlling partial oxidation in an oxidizing atmosphere to a density level at which the fibers will not burn when subjected to an ordinary match flame and are capable of sustaining conventional carbonization temperatures to produce carbon fibers. The process of the invention involves the utilization of selected treatment temperature modes for the fiber as it passes through varying density ranges during oxidative stabilization. Acrylic fibers, as referred to throughout the specification and claims, are acrylonitrile homopolymer fibers and copolymer fibers containing at least about 80 mol % acrylonitrile. These fibers are routinely supplied in the form of tows comprising continuous multifilament bundles conventionally containing about 1,000 to about 160,000 individual fibers.

The thermal stabilization of a bundle of acrylic fibers historically has required a heat treatment of relatively long duration (e.g., elapsed time of at least about 4 hours). A lengthy heating period has normally been required to produce a density level at which an acrylic fiber bundle is non-burning when subjected to an ordinary match flame and will withstand carbonization temperatures, in view of the fact that rapid heating during stabilization to temperatures in the vicinity of the exothermic transition point of a fiber bundle produces "run-away" intermolecular cross-linkage reactions which result in local accumulation of heat. These "hot spots" in the bundle cause uneven heat distribution and result in the formation of a highly viscous liquid substance which, at the temperature of formation, causes fusion (i.e., a bonding) of the individual fibers, and may result in complete fragmentation of the fiber bundle. The fusion temperature is defined as that temperature at which formation of the highly viscous liquid substance is initially observed to form. The extensive time required for acrylic fiber stabilization has been a primary cause of relatively low production rates and associated high manufacturing costs for commercial carbon fiber production.

SUMMARY OF THE INVENTION

The present invention provides a process for rapidly thermally stabilizing a bundle of acrylic fibers in an oxidizing atmosphere, under a tension at least sufficient to prevent significant fiber shrinkage, comprising the steps of: (a) directly exposing the bundle of fibers to a heat treatment temperature in the range of about 2° C. to about 8° C. below a predetermined temperature at which fusion of a segment of the bundle of fibers is observed to occur; (b) immediately decreasing the heat treatment temperature of the bundle of fibers at a predetermined rate wherein the temperature is constantly maintained at about the maximum which the bundle of fibers can tolerate without fusing as the fiber density is simultaneously and progressively increased until a critical density is attained at which the bundle of fibers will tolerate an increase in temperature without fusing; and then (c) immediately increasing the heat treatment temperature of the bundle of fibers at a predetermined rate wherein the temperature is constantly maintained at about the maximum which the bundle of fibers can tolerate without fusing as the fiber density is simultaneously and progressively increased to a level at which the bundle is capable of sustaining carbonization at a temperature of at least about 800° C. in a non-oxidizing atmosphere.

As used herein, the phrase "about the maximum which the bundle of fibers can tolerate without fusing" refers to a temperature in the range of about 2° C. to about 8° C. below the fusion temperature, as hereinbefore defined, is observed to be attained for the fibers of a bundle at a particular density. Additionally, "significant fiber shrinkage" is defined as no more than about 5% shrinkage.

DESCRIPTION OF THE DRAWING

The single drawing is a graphic representation of a time/temperature profile developed according to one aspect of the invention for use in the stabilization of a bundle of acrylic fibers.

DETAILED DESCRIPTION OF THE INVENTION

Generally, the process of the invention initially involves a preliminary determination of the fusion temperature of a segment of an acrylic fiber bundle of the specific type to be treated. This may be accomplished by exposing separate segments of this bundle, in an appropriate oxidizing atmosphere, to individual temperature levels which are gradually elevated, preferably in 1° C. increments near the point where fusion is observed, until a temperature is attained at which a segment is observed to fuse immediately upon exposure to a particular temperature level. A separate segment must be used for each temperature increment to prevent an incorrect fusion point value due to slight stabilization of the fiber bundle resulting from exposure to gradually elevating temperatures.

This determination, and the temperature determinations described below, are carried out under essentially the same conditions (e.g., fiber tension, oxidation atmosphere, bundle physical size and number of filaments comprising the bundle) that will be used in the actual plant scale fiber stabilization.

The acrylic fiber bundle to be stabilized is initially exposed directly to a treatment temperature of about 2° C. to about 8° C. below the fusion temperature determined using the procedure outlined above. Immediately following the exposure of the bundle to a temperature in this range, the treatment temperature is immediately decreased during a first period to prevent gradual fusion of the individual fibers of the bundle. The rate of temperature reduction during this period is determined experimentally by ascertaining the maximum temperatures which the fiber bundle can tolerate as the fiber density is progressively increased and employing this rate of temperature reduction for treating the bundle.

When the fibers have attained a particular density, hereinafter referred to as the critical density, by this treatment, the actual value depending on the characteristics of the particular fiber bundle being stabilized, they are capable of tolerating a progressive increase in temperature in a second treatment period, but this must also be carried out at a predetermined rate to prevent fusion of the fibers. This upheat rate is also determined experimentally and is applied to the fiber bundle until a density is attained which allows conventional carbonization.

Fiber treatment may be accomplished in a batch process using an oven having means for closely controlling the varying treatment temperatures, or a continuous process wherein the fiber bundle is passed through heating means designed to provide the appropriate time/-temperature treatment profile for particular grades of acrylic fiber.

The process of the invention typically provides thermal stabilization of an acrylic fiber bundle in about 10 to 30% of the time conventionally required for such treatment.

DESCRIPTION OF THE PREFERRED EMBODIMENT

The experiments described hereinbelow are carried out in an oven having an air atmosphere under essentially the same conditions as will be used in plant scale fiber stabilization.

The fusion temperature of a segment of fiber tow composed of 40,000 acrylic fibers having a fiber density of about 1.2 g/cm$^3$ is determined by supporting the segment between two clips at a tension in the range of about 0.04 to 0.06 grams/denier. The segment is placed in an oven heated to a temperature of 275° C. and observed. No fusion being noted, the sample is removed from the oven, the temperature of the oven is increased 10° C., and a new sample is placed therein. This process is repeated until fusion of a sample is observed immediately upon exposure to a temperature of 335° C. The temperature of the oven is then lowered to 325° C. and the process is again repeated as the temperature is raised in increments of 1° C. until fusion of a segment is immediately observed at 330° C.

Next, a sample of tow identical to that from which the segments of tow were taken for the experiment above is mounted in the same configuration and under the same tension used therefor such that the tow is prevented from sagging and shrinking, and the mounted tow is exposed to a temperature of about 325° C. (5° C. below the tow segment fusion temperature). The temperature is then immediately decreased to 320° C. and held at that selected temperature (T) until fusion is observed, the exact time of 58 seconds required for fusion being recorded.

A second mounted sample of tow is placed in the oven at a temperature of 325° C. and the temperature is immediately decreased to temperature (T) and held for a period of time slightly less (ca. 5 seconds) than the time determined for fusion to occur at that temperature. The temperature of the oven is again decreased to a temperature ($T_1$) of 315° C. and held until fusion is observed, the time to fusion of 1 minute and 47 seconds being recorded.

This process is repeated, starting with a new sample being initially exposed to 325° C. for each trial and following the step-wise time/temperature profile as the temperature is progressively decreased until a temperature point (P) of 271° C. is attained at which the fiber density is at a level where no fusion characteristics are exhibited after exposure of one hour. This temperature point is the one which produces the critical density at which the tow can tolerate a controlled increase in temperature. An elapsed time of exactly 9 minutes was required to reach this density.

A new mounted tow sample is placed in the oven at 325° C. and the time/temperature profile determined above is followed until temperature (P) is reached. The temperature is then immediately increased until fusion is observed at a temperature (X) of 277° C.

A new mounted sample of tow is then placed in the oven at 325° C. and the time/temperature profile previously determined, including the reversal from progressively decreasing to increasing temperature at point (P), is followed until a temperature 2° C. below temperature (X) of 275° C., designated ($X_1$), is attained and is held thereat for 5 seconds. As no fusion is observed, the total elapsed time of 9 minutes and 53 seconds required for this heating period is recorded.

A new mounted sample of tow is then placed in the oven at 325° C. and the predetermined time/temperature profile is followed through the holding period (5 seconds) for temperature ($X_1$). The heat treatment temperature is then immediately increased until fusion is observed at temperature (Y) of 282° C. A new tow sample is placed in the oven at 325° C. and the predetermined time/temperature profile is followed until a temperature 2° C. below temperature (Y) of 280° C., designated ($Y_1$), is attained and is held thereat for 5 seconds. As no fusion is observed, the total elapsed time of 11 minutes and 20 seconds is recorded.

It has previously been determined that a density of at least about 1.35 g/cm$^3$ is required for this particular tow to sustain carbonization at a temperature of at least about 800° C. in a non-oxidizing atmosphere. Therefore, new mounted tow samples are placed in the oven as required and the temperature is increased in a step-wise manner following the above procedure until this density is attained.

The fiber density at each temperature level may be determined by treating a sample of tow according to the temperature rate profile developed to a particular level, flooding the oven with nitrogen to stop the oxidation reaction, removing the sample from the oven, and measuring the density by means well known in the art.

Using the data obtained in the experiments above, a time/temperature profile graph, shown in the drawing, is constructed. The time/temperature parameters illustrated may be utilized for rapid acrylic fiber stabilization in an oxidizing atmosphere for the particular type of tow used in determining the graph's plot by controlling the heat treatment of the tow in the range of about 2° C. to 8° C. below the indicated temperatures while generally adhering to the indicated time sequence.

A sample of this tow is mounted in the same manner as in the experiments above and placed in an oven with an air atmosphere at a temperature of 325° C. and the time/temperature treatment parameters are regulated to essentially follow the shape of the graph at about 5° C. below the profile line. After a stabilizing cycle of 23 minutes the sample is removed from the oven. The stabilized tow has a fiber density value of 1.360 g/cm$^3$ and is thus capable of sustaining conventional carbonization at 800° C. in a non-oxidizing atmosphere.

While the invention has been described in detail and with reference to a specific embodiment thereof, it will be apparent to one skilled in the art that various changes and modifications can be made therein without departing from the scope and spirit thereof, and, therefore, the invention is not intended to be limited except as indicated in the appended claims.

What is claimed is:

1. A process for rapidly thermally stabilizing a bundle of acrylic fibers in an oxidizing atmosphere, under a tension at least sufficient to prevent significant fiber shrinkage, comprising the steps of:

(a) directly exposing the bundle of fibers to a heat treatment temperature in the range of about 2° C.

to about 8° C. below a predetermined temperature at which fusion of a segment of said bundle of fibers is observed to occur;

(b) immediately decreasing the heat treatment temperature of the bundle of fibers at a predetermined rate wherein said temperature is constantly maintained at about the maximum which said bundle of fibers can tolerate without fusing as the fiber density is simultaneously and progressively increased until a critical density is attained at which said bundle of fibers will tolerate an increase in temperature without fusing; and then (c) immediately increasing the heat treatment temperature of the bundle of fibers at a predetermined rate wherein said temperature is constantly maintained at about the maximum which said bundle of fibers can tolerate without fusing as the fiber density is simultaneously and progressively increased to the level at which said bundle of fibers is capable of sustaining carbonization at a temperature of at least about 800° C. in a non-oxidizing atmosphere.

2. The process of claim 1 wherein the fiber bundle is held at a tension in the range of about 0.04 to about 0.06 grams/denier.

3. The process of claims 1 or 2 wherein the final density of the fiber is at least about 1.35 g/cc.

* * * * *